US010170827B2

(12) United States Patent
Chen

(10) Patent No.: US 10,170,827 B2
(45) Date of Patent: Jan. 1, 2019

(54) HOUSING STRUCTURE HAVING CONDUCTIVE ADHESIVE ANTENNA AND CONDUCTIVE ADHESIVE ANTENNA THEREOF

(71) Applicants: TennVac Inc., New Taipei (TW); TennMAX America Inc., Vancouver, WA (US)

(72) Inventor: Guan-Yu Chen, New Taipei (TW)

(73) Assignees: TENNVAC INC., New Taipei (TW); TENNMAX AMERICA INC., Vancouver, WA (US)

( * ) Notice: Subject to any disclaimer, the term of this patent is extended or adjusted under 35 U.S.C. 154(b) by 38 days.

(21) Appl. No.: 15/404,780

(22) Filed: Jan. 12, 2017

(65) Prior Publication Data

US 2018/0108983 A1 Apr. 19, 2018

Related U.S. Application Data

(60) Provisional application No. 62/408,235, filed on Oct. 14, 2016.

(51) Int. Cl.

| | |
|---|---|
| ***H01Q 1/42*** | (2006.01) |
| ***H01Q 7/00*** | (2006.01) |
| ***H01Q 1/24*** | (2006.01) |
| ***H01Q 1/44*** | (2006.01) |
| ***G04R 60/06*** | (2013.01) |
| *H01Q 1/27* | (2006.01) |
| *H01Q 9/04* | (2006.01) |
| *H01Q 9/26* | (2006.01) |
| *H01Q 9/42* | (2006.01) |

(52) U.S. Cl.

CPC ..... *H01Q 1/42* (2013.01); *G04R 60/06* (2013.01); *H01Q 1/243* (2013.01); *H01Q 1/44* (2013.01); *H01Q 7/00* (2013.01); *H01Q 1/273* (2013.01); *H01Q 9/0421* (2013.01); *H01Q 9/265* (2013.01); *H01Q 9/42* (2013.01)

(58) Field of Classification Search

None

See application file for complete search history.

(56) References Cited

U.S. PATENT DOCUMENTS 5,949,384 A * 9/1999 Ikushima ..... H01Q 7/02 343/866

8,749,436 B2 * 6/2014 Yabe ..... H01Q 9/42 343/702

(Continued)

*Primary Examiner* — Trinh Dinh

(74) *Attorney, Agent, or Firm* — Juan Carlos A. Marquez; Marquez IP Law Office, PLLC

(57) ABSTRACT

The present invention discloses a housing structure having a conductive adhesive antenna and the conductive adhesive antenna thereof, wherein the housing structure having the conductive adhesive antenna comprises a housing and an electrically conductive adhesive. The housing has two units which can be integrated with each other to form a bonding portion. The electrically conductive adhesive is bonded on the bonding portion and has at least one electrical connection end for electrically connecting with a wireless module, thereby the electrically conductive adhesive is also formed as an antenna structure. With the implementation of the present invention, the conductive adhesive antenna can replace a prior antenna.

4 Claims, 7 Drawing Sheets

(56) References Cited

U.S. PATENT DOCUMENTS

| | | | | |
|---|---|---|---|---|
| 8,941,610 | B1 * | 1/2015 | Rivera | G06F 1/1643 343/702 |
| 9,911,079 | B2 * | 3/2018 | Kato | G06K 19/07749 |
| 2006/0122666 | A1 * | 6/2006 | Nghiem | A61N 1/37229 607/60 |
| 2011/0234459 | A1 * | 9/2011 | Yabe | H01Q 1/243 343/702 |
| 2015/0138023 | A1 * | 5/2015 | Hyun | H01Q 1/243 343/702 |
| 2016/0276737 | A1 * | 9/2016 | Nakamura | H01Q 1/243 |
| 2018/0063485 | A1 * | 3/2018 | Sannala | H04W 4/80 |

* cited by examiner

HOUSING STRUCTURE HAVING CONDUCTIVE ADHESIVE ANTENNA AND CONDUCTIVE ADHESIVE ANTENNA THEREOF

BACKGROUND OF THE INVENTION

1. Technical Field

The present invention relates to a housing structure having a conductive adhesive antenna and the conductive adhesive antenna thereof. More particularly, it is applied to electronic products with a housing structure having a conductive adhesive antenna and the conductive adhesive antenna thereof.

2. Description of Related Art

An antenna is an electronic component used to transmit or receive radio waves, or more generally, the antenna is an electronic component of an electromagnetic wave. Antennas are used in systems such as radios and televisions, point-to-point radio communications, radar and space explorations. Antennas usually work in the air or outer space, and can also be operated underwater, even at certain frequencies, in soils and rocks.

In general, as long as the radio waves are used, it needs to use the antenna to assist the transmission and reception of the radio waves. According to the working frequency band of the antennas, the antennas can be classified into ultra-long wave antennas, long wave antennas, ultra-short wave antennas and microwave antennas, which can be applied into the defense industry and the livelihood industry. Depending on the wavelength of the radio waves, the sizes of the antenna are very different. For example, the size of the antenna using in around the 100 MHz and the size of the antenna using in the 2.4 GHz of WLAN are very different. According to its direction, the antennas can be roughly classified into omni-directional antenna and directional antenna.

In general electronic devices, the antennas are often designed on a circuit board or an independent antenna is used. If the volume of the electronic device is large enough, of course, the antenna design has fewer restrictions. However, in some portable electronic devices, or in some special applications, it is necessary to take the volume and the thickness of the device, or even the integration of the antenna and the mechanism into consideration. For example, for providing an antenna in a portable headset, the volume and thickness of the portable headset should be taken into consideration. In this kind of case, the conventional antenna structure is not possible to fit in.

BRIEF SUMMARY OF THE INVENTION

The present invention relates to solve various limitations, such as size, cost and special application in antenna design of electronic products with wireless functionality.

The present invention provides a housing structure having a conductive adhesive antenna, comprising: a housing having a first unit and a second unit, both of which can be integrated with each other to form a bonding portion; and an electrically conductive adhesive bonded to the bonding portion, so that the electrically conductive adhesive and the bonding portion form a sealed structure and the electrically conductive adhesive has at least one electrical connection end for electrically connecting with a wireless module, thereby the electrically conductive adhesive is formed as an antenna structure.

The present invention also provides a conductive adhesive antenna structure which is an electrically conductive adhesive having at least one electrical connection end for electrically connecting with a wireless module so that the electrically conductive adhesive is formed as an antenna structure.

Implementation of the present invention at least involves the following inventive steps:

1. The manufacturing cost can be lowered and the space is saved, because the electrically conductive adhesive is used as an antenna.

2. Due to the usage of the electrically conductive adhesive as the antenna, the antenna design has more flexibility and creates new applications, especially the applications of the wireless products, such as wireless headphones, which require in light and slim.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

DETAILED DESCRIPTION OF THE INVENTION

Figure 1A:
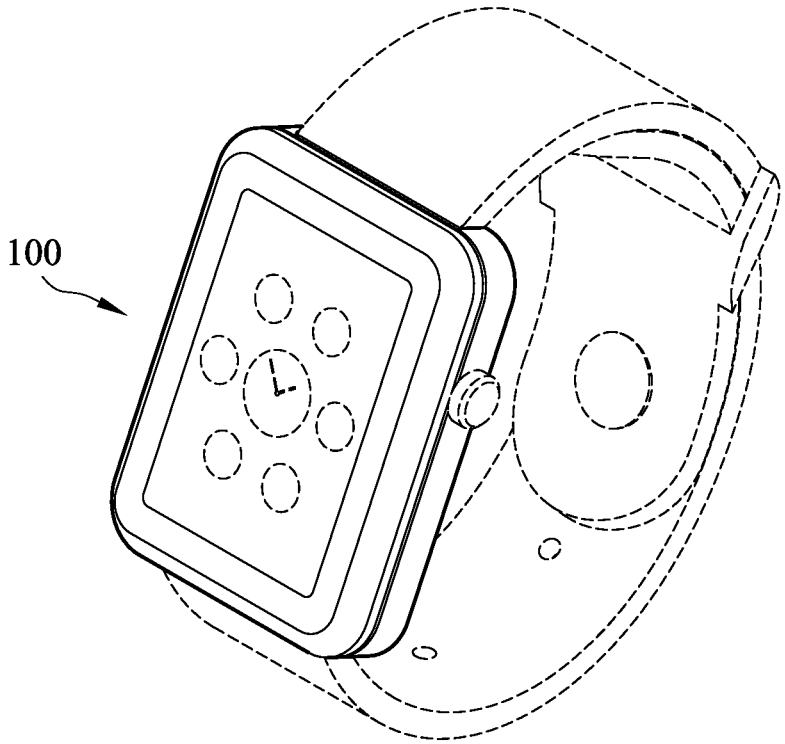
FIG. 1A is a schematic drawing of an embodiment of the present invention applied to a smartwatch.
Figure 1B:
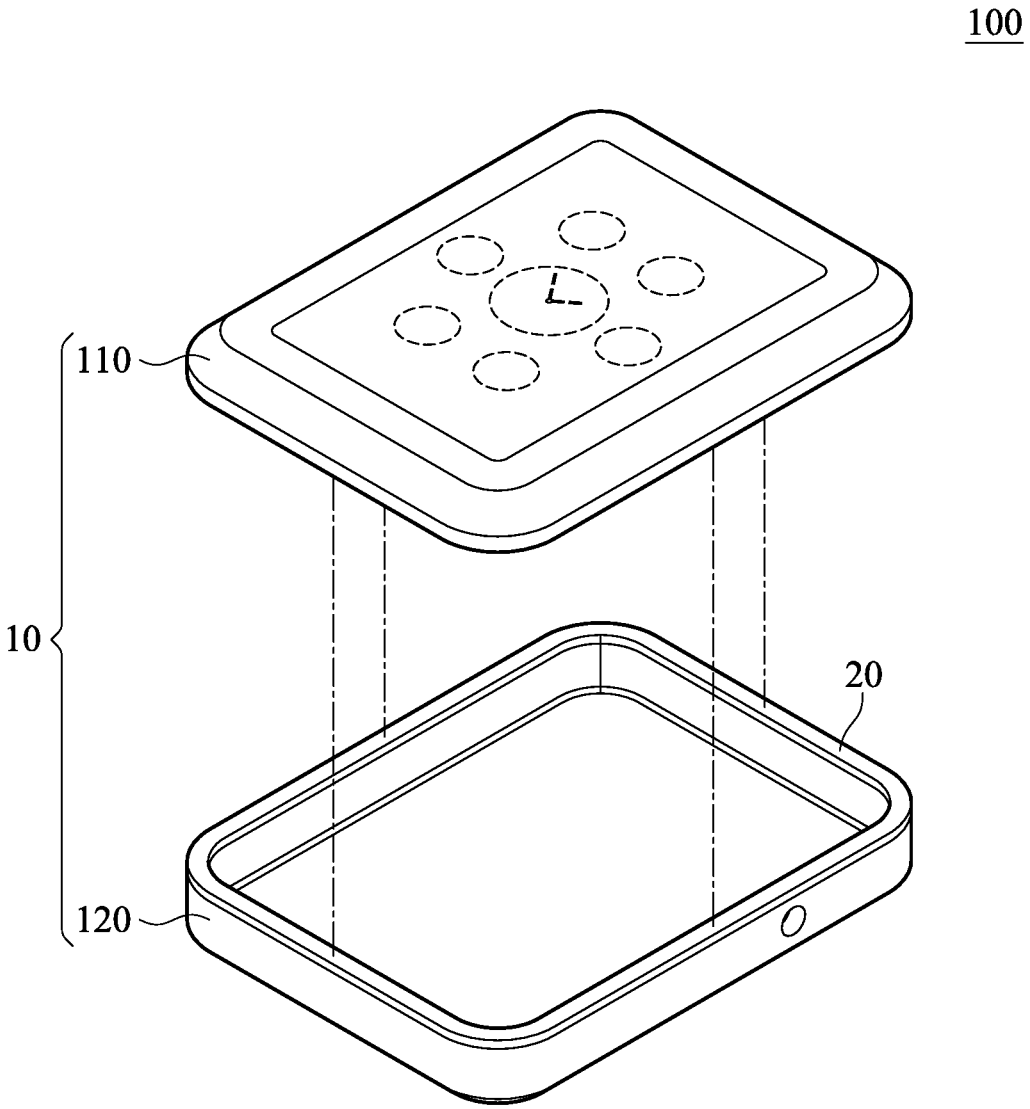
FIG. 1B is a exploded schematic drawing showing a partial smartwatch according to an embodiment of the present invention applied to the smartwatch.
Figure 2A:
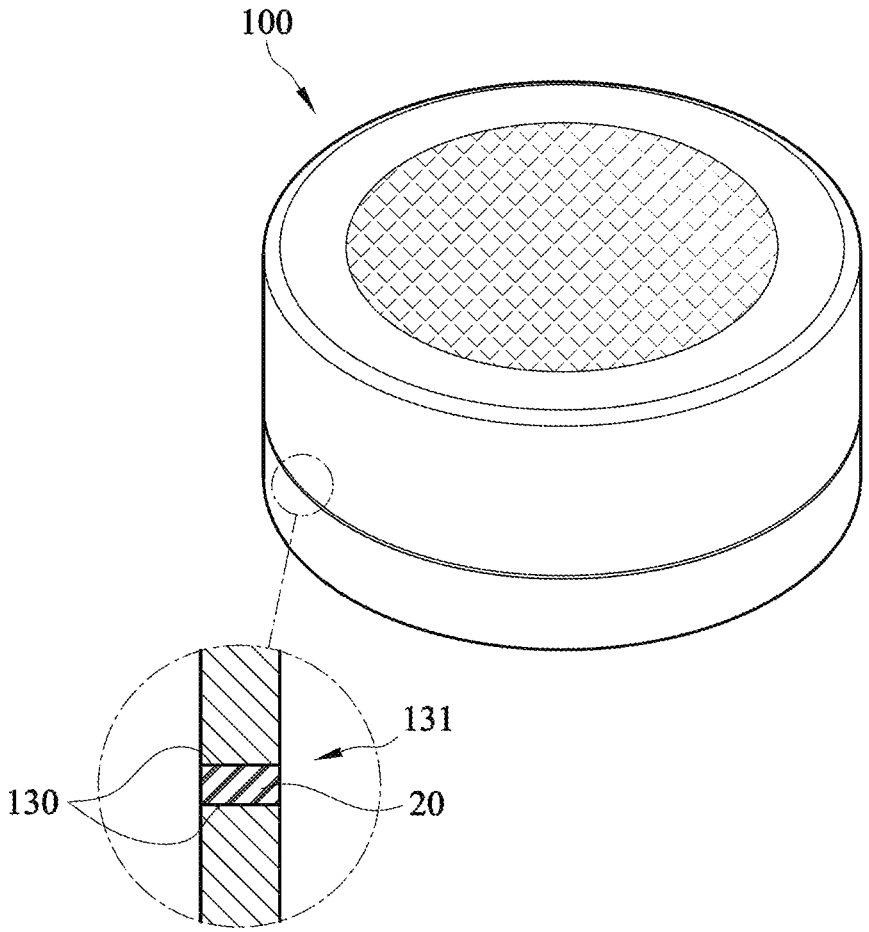
FIG. 2A is a schematic drawing of an embodiment of the present invention applied to a Bluetooth speaker.
Figure 2B:
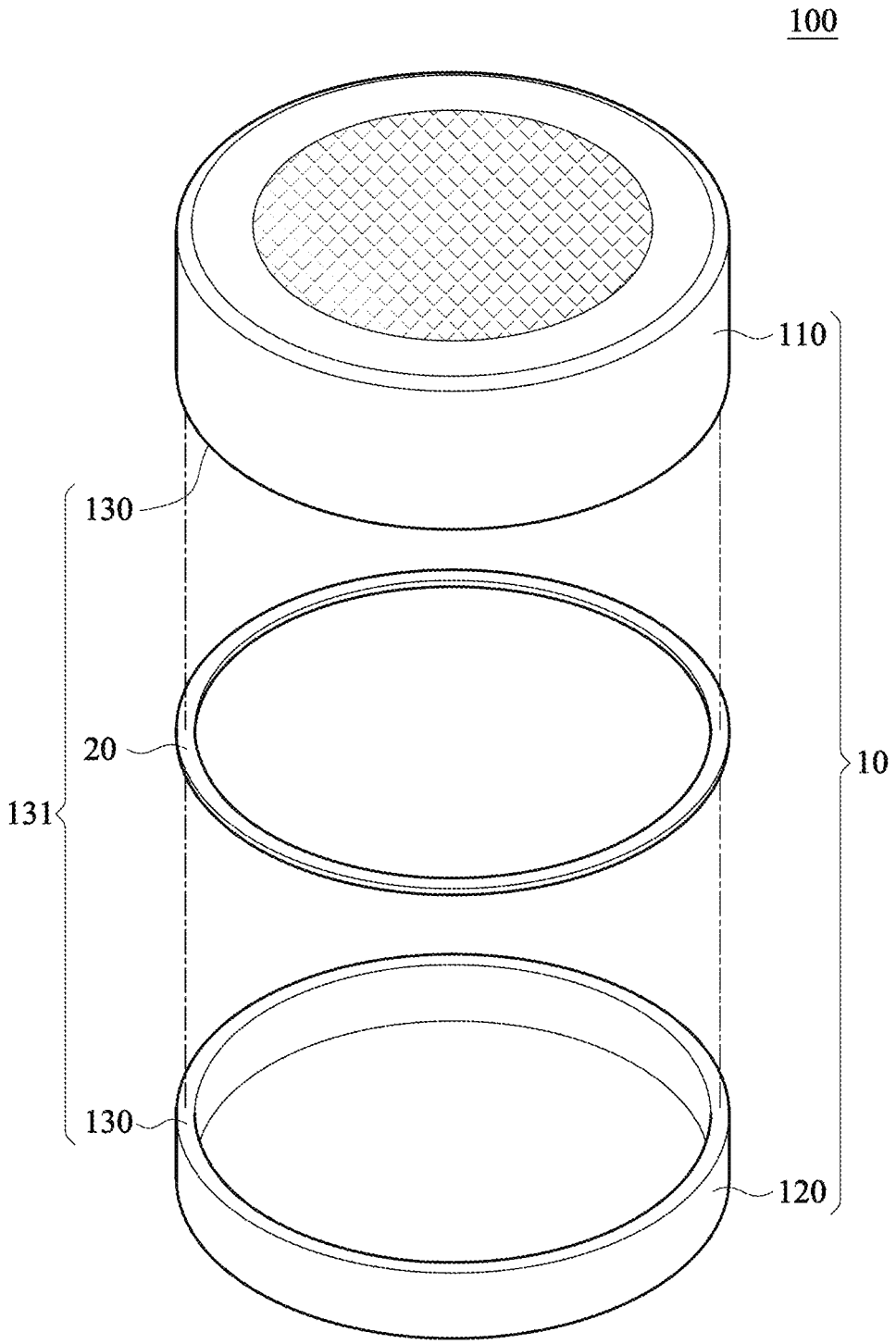
FIG. 2B is a exploded schematic drawing showing a partial Bluetooth speaker according to an embodiment of the present invention applied to the Bluetooth speaker.

Referring to FIG. 1A to FIG. 2B, the present embodiment is a housing structure 100 having a conductive adhesive antenna, which comprises a housing 10 and an electrically conductive adhesive 20.

The housing 10 may be applied to electronic products such as a waterproof wearable smartwatch, a VR (Virtual Reality) device, a waterproof Internet 3Com IOT (Internet of Things), a waterproof Bluetooth headset, a waterproof mini WIFI router, a FM glass intelligent window of Wisdom Home, a glass panel of cars or motorcycles, or wireless charging pad and so on.

The above-mentioned housing 10 has a first unit 110 and a second unit 120, which can be integrated with each other and form a bonding portion 130. The first units 110 and the second units 120 may be combined in the way of plastic-to-plastic, plastic-to-glass, metal-to-plastic or metal-to-glass. After the first unit 110 and the second unit 120 are combined, the bonding portion 130 is inevitably formed therebetween.

As the bonding portion is a kind of mechanism combination, therefore, the air-tightness, water-tightness, or dust-proof effect is poor and the electromagnetic interference (EMI), the electromagnetic compatibility (EMC), or the electrostatic discharge (ESD) cannot be effectively blocked. Thus, an electronic structure in the housing 10 can be impacted by moisture, dust, EMI, EMC or ESD and lead to low stability, short life time, or interference.

In order to solve the above-described problems, the above-described bonding portion 130 is bonded by the electrically conductive adhesive 20 and to form a sealed structure 131 in the bonding portion 130, so that it is possible to effectively achieve water-proof, moisture-proof, dust-proof, anti-EMI, anti-EMC or anti-ESD. The waterproof rating of the housing 10 of the present embodiment can achieve to IP68 rating (Ingress Protection Rating 68) after using the electrically conductive adhesive 20 of the present invention.

Figure 3A:
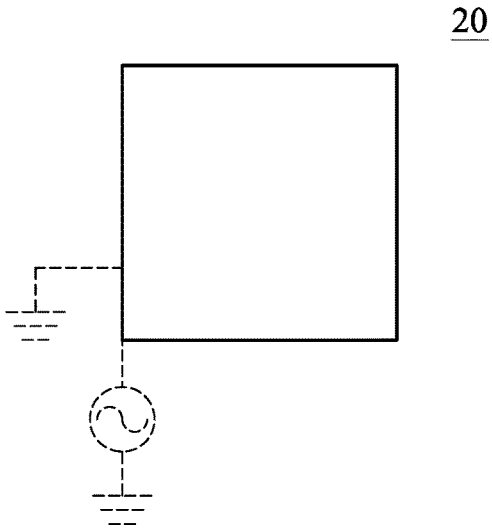
FIG. 3A to FIG. 3C show an equivalent circuit diagram that an electrically conductive adhesive is formed as a loop antenna in an embodiment of the present invention, respectively.
Figure 3B:
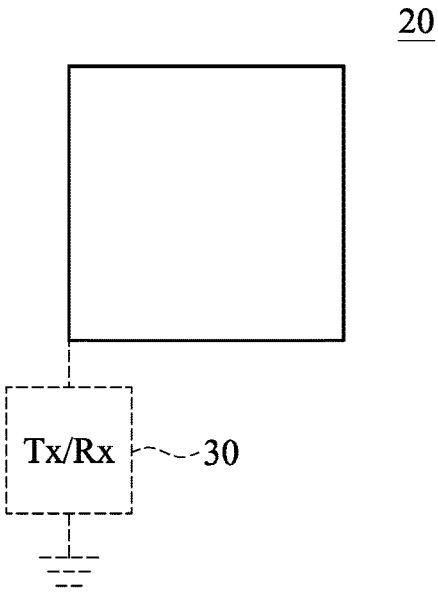
Figure 3C:
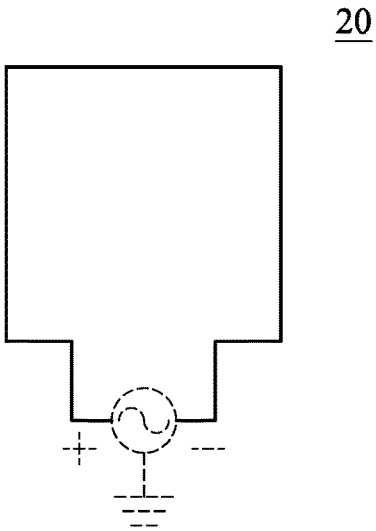
Figure 4A:
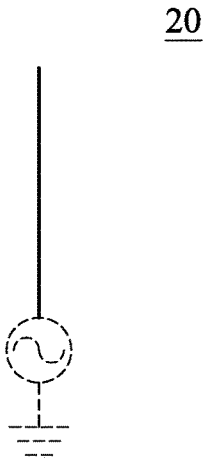
FIG. 4A to FIG. 4F show an equivalent circuit diagram that an electrically conductive adhesive is formed as an open loop antenna in an embodiment of the present invention, respectively.
Figure 4B:
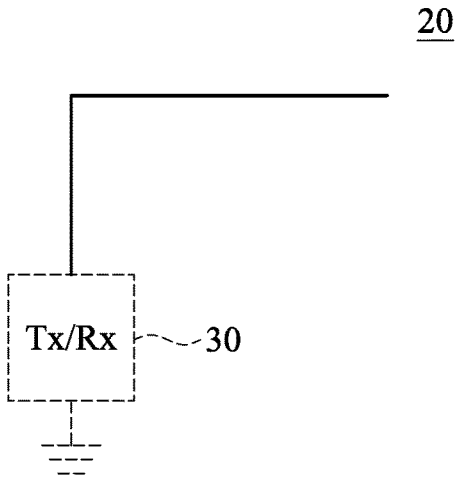
Figure 4C:
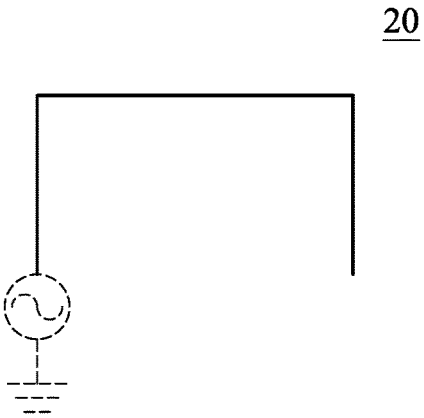
Figure 4D:
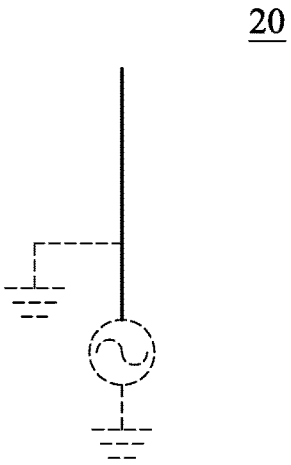
Figure 4E:
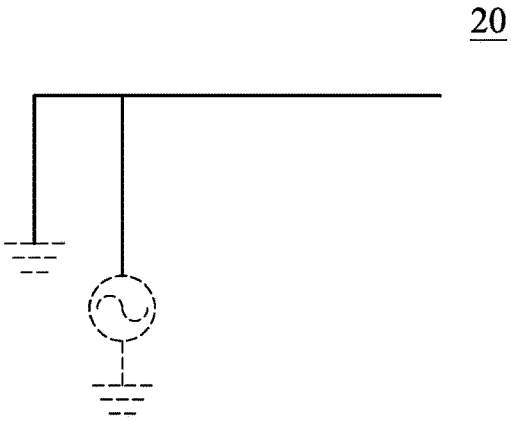
Figure 4F:
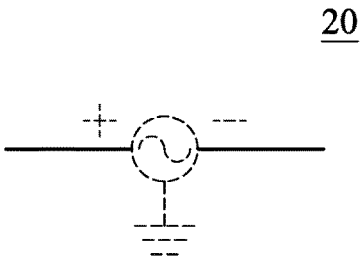

Referring to FIG. 3A to FIG. 4F, the electrically conductive adhesive 20 of the present invention has at least one electrical connection end, which may be any portion of the electrically conductive adhesive 20, and therefore, the electrical connection end does not require any particular design. When the electrically conductive adhesive 20 is electrically connected with a signal source or a ground terminal, the portion of contact naturally forms the electrical connection end. When the electrical connection end is electrically connected to a wireless module 30 for transmitting or receiving a signal, the electrically conductive adhesive 20 forms as an antenna structure, due to its conductive properties.

In addition to the known material, the electrically conductive adhesive 20 also can be a form-in-place conductive and waterproof colloid, being composed of: 9%-12% of dimethyl siloxane or dimethylvinyl-terminated or vinyl terminated polydimethylsiloxane; 12%-15% of hydroxy terminated polydimethylsiloxane; 0%-0.2% of dispersant; 3%-5% of dimethyl, methylhydrogen siloxane crosslinking agent; 0%-0.2% of adhesion promoter; 0%-0.2% of Pt catalyst; 1%-3% of forming agent; 0%-10% of hydrocarbon solvent; 50%-70% of Nickel Graphite; 0%-0.2% of thickening agent; 5%-10% of trimethylated silica; and 0%-0.1% of inhibitor.

As described above, the form-in-place conductive and waterproof colloid or adhesive is formed in the bonding portion in a dispensing manner or by an automatic filling machine.

The above-mentioned form-in-place conductive and waterproof colloid or adhesive has the following characteristics: the adhesion strength is larger than 80 N/cm2; the shielding capability is larger than 100 dB in the frequency spectrum range from 200 MHz to 20 GHz; the minimum width is 0.4 mm; the minimum height is 0.3 mm; and the filling width of the dispensing path is between 0.4 mm and 2 mm.

In view of the above, the present invention can use the electrically conductive adhesive simultaneously as a hermetically sealed member and an antenna without additionally providing an antenna element, thereby the space and cost can be greatly saved and it also can increase the design flexibility of the application.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A housing structure having conductive adhesive antenna, comprising:

a housing having a first unit and a second unit, both of which are integrated with each other to form a bonding portion; and an electrically conductive adhesive bonded to the bonding portion, so that the electrically conductive adhesive and the bonding portion form a sealed structure and the electrically conductive adhesive has at least one electrical connection end for electrically connecting with a wireless module, thereby the electrically conductive adhesive is formed as an antenna structure.

2. The housing structure according to claim 1, wherein the housing is a plastic member and a waterproof rating of the housing structure is up to IP68.

3. The housing structure according to claim 1, wherein the electrically conductive adhesive is a waterproof-conductive adhesive.

4. The housing structure according to claim 1, wherein the antenna structure is a loop antenna structure.

* * * * *